US005768754A

United States Patent [19]

Armstrong

[11] Patent Number: 5,768,754

[45] Date of Patent: Jun. 23, 1998

[54] FABRIC FASTENING KIT

[76] Inventor: Peter E. Armstrong, Box 4, Site 1A, Black Point, Nova Scotia, Canada, BOJ IBO

[21] Appl. No.: 747,106

[22] Filed: Nov. 8, 1996

[51] Int. Cl.[6] ..... A47H 23/00

[52] U.S. Cl. ..... 24/442; 160/327; 297/218.3

[58] Field of Search ..... 24/442; 11/380, 11/354; 428/100; 297/228.13, 225, 218.3, 219.1; 411/461, 457, 477; 248/74.3; 5/194; 160/327

[56] References Cited

U.S. PATENT DOCUMENTS

| | | | |
|---|---|---|---|
| 584,148 | 6/1897 | Robinson . | |
| 1,212,676 | 1/1917 | Porter . | |
| 1,782,695 | 11/1930 | Prez | 5/194 X |
| 2,051,191 | 8/1936 | Watson | 411/461 X |
| 2,417,922 | 3/1947 | Frazer . | |
| 2,608,243 | 8/1952 | Kostrowski | 297/218.3 |
| 3,117,817 | 1/1964 | Mednick . | |
| 3,166,117 | 1/1965 | Abadjieff . | |
| 3,181,598 | 5/1965 | Schneider . | |
| 3,248,147 | 4/1966 | Testa . | |
| 3,308,598 | 3/1967 | Wilson . | |
| 3,480,069 | 11/1969 | Handwerker | 160/354 |
| 3,785,426 | 1/1974 | Sperling . | |
| 3,822,734 | 7/1974 | Tombu . | |
| 4,067,609 | 1/1978 | Ness . | |
| 4,151,665 | 5/1979 | Gibby . | |
| 4,342,356 | 8/1982 | Sickels et al. | 160/327 X |
| 4,641,474 | 2/1987 | Cannarsa | 411/461 X |
| 4,782,883 | 11/1988 | Braiotta | 160/327 X |
| 4,867,222 | 9/1989 | Roman et al. | 160/354 X |
| 4,878,531 | 11/1989 | Stover . | |
| 5,586,595 | 12/1996 | Takizawa et al. | 24/442 X |

FOREIGN PATENT DOCUMENTS

| | | | |
|---|---|---|---|
| 1179013 | 1/1970 | Australia | 160/354 |
| 541836 | 10/1955 | Belgium . | |
| 608286 | of 1957 | Canada . | |
| 617710 | of 1957 | Canada . | |
| 2029819 | 1/1992 | Canada . | |
| 732517 | 6/1932 | France | 5/194 |
| 1186436 | 2/1959 | France . | |
| 1912744 | 10/1970 | Germany | 24/442 |
| WO 91/03198 | 3/1991 | WIPO . | |

*Primary Examiner*—Peter R. Brown
*Assistant Examiner*—Hanh V. Tran
*Attorney, Agent, or Firm*—Mario D. Theriault

[57] ABSTRACT

A fabric fastening kit for fastening a piece of fabric to a rigid structure. The fabric fastening kit is comprised of a strip of netting material having a nominal width and a plurality of opened meshes, and a longitudinal pronged element having a nominal thickness, a surface, a backside, a foreside, and a plurality of juxtaposed prongs defined within that planar surface. Each prong has a narrow tip, a wide base and a length between the tip and the base being at least equivalent to the width of the base of one prong. The pronged element is attachable to a rigid structure. The strip of netting material is attachable to the pronged element and is also attachable to the margin of the piece of fabric to be fastened to the rigid structure. Each of the meshes of the netting material has a perimeter which is at least twice as long as the total of the width of the base of one prong plus the nominal thickness of the prong, whereby when the pronged element is mounted on the rigid structure, the netting material is repeatedly tangentially attachable to and removable from the pronged element without mangling the netting material. In another aspect of the present invention, the pronged element has a spacer means mounted on the backside thereof for spacing the prongs from the surface of the structure when the pronged element is attached to that structure.

20 Claims, 5 Drawing Sheets

FABRIC FASTENING KIT

FIELD OF THE INVENTION

This invention relates to fabric fastening systems, and more particularly, it relates to a kit comprised of a strip of netting material and a pronged element, for removably fastening a piece of fabric to a rigid structure.

BACKGROUND OF THE INVENTION

A number of different systems have been developed in the past for fastening a piece of fabric to a rigid structure. For examples, such systems have been largely used for retaining wall covering fabrics against a wall surface, for retaining curtains to a window frame, and for fastening upholstery material to a furniture base.

A first example of a wall covering support structure is disclosed in U.S. Pat. No. 4,878,531 issued on Nov. 7, 1989 to Douglas F. Stover. In this support structure, the wall fabric is attachable to a pronged strip mounted along the upper edge of a wall. A similar pronged strip is installed along the base of the wall for retaining the lower margin of the fabric. Each pronged strip is subsequently covered by a decorative wooden molding.

Additional similar systems for retaining a wall fabric or a curtain to a rigid structure, using pronged elements, are disclosed in the following documents:

- U.S. Pat. No. 2,417,922 issued on Mar. 25, 1947 to J. E. Frazer;
- U.S. Pat. No. 3,166,117 issued on Jan. 19, 1965 to I. V. Abadjieff;
- U.S. Pat. No. 3,785,426 issued on Jan. 15, 1974 to P. Sperling; and
- U.S. Pat. No. 3,822,734 issued on Jul. 9, 1974 to G. Tombu.

The systems of the prior art for supporting wall fabrics and curtains have one feature in common. All systems have rigid prongs which are intended to pierce through the fabric, to break the fibres of the material and to form apertures having the size of each prong. For this reason, these systems of the prior art are not appropriate for temporarily fastening a fabric to a wall, such as for social receptions and annual events for examples. These system are not appropriate either for stretching or otherwise adjusting the position of a piece of material in relation to the pronged elements, without effecting a series of perforations along the margin of the piece, thereby damaging the fabric.

A similar drawback exists with some fabric fastening systems presently in use in the upholstery industry. In this regard, several documents of the prior art disclose the advantages of using pronged elements for retaining upholstery material over the frame of a chair, a sofa, interior panels of vehicles or similar structures of furniture. Examples of documents disclosing the use of pronged elements to retain upholstery material are the following:

- Belgium Patent 541,836 issued on Oct. 31, 1955 to P. Reggiani;
- French Patent 1,186,436 issued on Feb. 23, 1959 to H. Steiner;
- U.S. Pat. No. 3,308,598 issued on Mar. 14, 1967 to E. Wilson.

Upholstery systems using pronged elements piercing through a fabric is normally used for retaining an original and permanent covering material over a piece of furniture. When the covering material is removed, it is generally discarded and replaced with a fresh permanent cover.

In the upholstery industry, slip covers are commonly used for protecting the original covering material of an article. These slip covers are removable, washable, and easily reinstalled over standard pieces of furniture. The prong elements of the prior art can hardly be used with these slip covers without mangling the margins of the cover beyond usefulness after only a few reinstallations.

Slip covers for furniture are typically installed with strings and tape around the lower part of the cover, as illustrated in U.S. Pat. No. 3,117,817, issued on Jan. 14, 1964 to L. Mednick.

Another common method for retaining a slip cover over a piece of furniture is by using Velcro™ fasteners mounted on the frame of the piece of furniture and along the lower edge of the cover. An example of a slip cover using Velcro™ fasteners is described in U.S. Pat. No. 3,248,147 issued on Apr. 26, 1966 to A. J. Testa.

A slip cover for a sofa or a chair often has separate sections, for covering the deck portion thereof or for lapping around the inside and outside surfaces of an arm rest for example. These sections have separate fringes which must be stretched and attached to ensure a proper fit of the cover over the structure of the chair or sofa. An inconvenience with the fastening systems of the prior art is that the fringes of the slip cover cannot be superimposed over one-another and fastened to a common fastener. Separate strings or separate Velcro TM strips must be provided for retaining each of these fringes separately.

For all these reasons, the fabric fastening systems of the prior art are generally not appropriate for fastening a piece of fabric in a temporary manner or for fastening several layers of fabric over a single retainer.

SUMMARY OF THE INVENTION

In the present invention, however, there is provided a fabric fastening kit which is comprised broadly of a strip of netting material having a nominal width and a plurality of opened meshes, and a pronged element. The pronged element is attachable to a rigid structure. The strip of netting material is attachable to the pronged element, and is also attachable to the margin of a piece of fabric to be fastened to the rigid structure.

In accordance to one aspect of the present invention, the pronged element is a longitudinal element having a surface and a plurality of juxtaposed prongs defined within that surface. The pronged element has a nominal thickness, and each of the prongs has a maximum base width. Each mesh of the netting material has a perimeter which is at least twice as long as a total of the maximum base width plus the nominal thickness of each prong, whereby the netting material is repeatedly attachable to and removable from the pronged element without mangling the netting material.

A first advantage of the fabric fastening kit of the present invention is that draperies and wall hangings of the like may be temporary fastened to a wall surface with such kit without piercing the edges of these fabrics. The fabric fastening kit of the present invention is particularly useful for temporary modifying the decorative scheme of an apartment and of the matching furniture, with wall fabrics and slip covers which remain removable and re-usable for installation at some later time.

In accordance to another aspect of the present invention, the strip of netting material has a nominal width comprised of a number of opened meshes. Therefore, when the strip of netting material is positioned in a parallel orientation with the pronged element, the strip of netting material is laterally adjustably attachable to the pronged element. The strip of netting material is laterally adjustable for levelling the header of a curtain for example, or for compensating for an imperfect mounting of the pronged element.

Other advantages of the fabric fastening kit of the present invention are numerous and comprise the facts that the components of the kit are easy to manufacture and easy to install on a many types of materials and structures. Moreover, the fabric fastening kit of the present invention has an applicability throughout the entire textile and flexible sheeting industries. Accordingly, several other typical applications are described in the following section.

BRIEF DESCRIPTION OF THE DRAWINGS

The preferred embodiment of the present invention will be further understood from the following description, with reference to the drawings in which.

DETAILED DESCRIPTION OF THE PREFERRED EMBODIMENT

Figure 1:
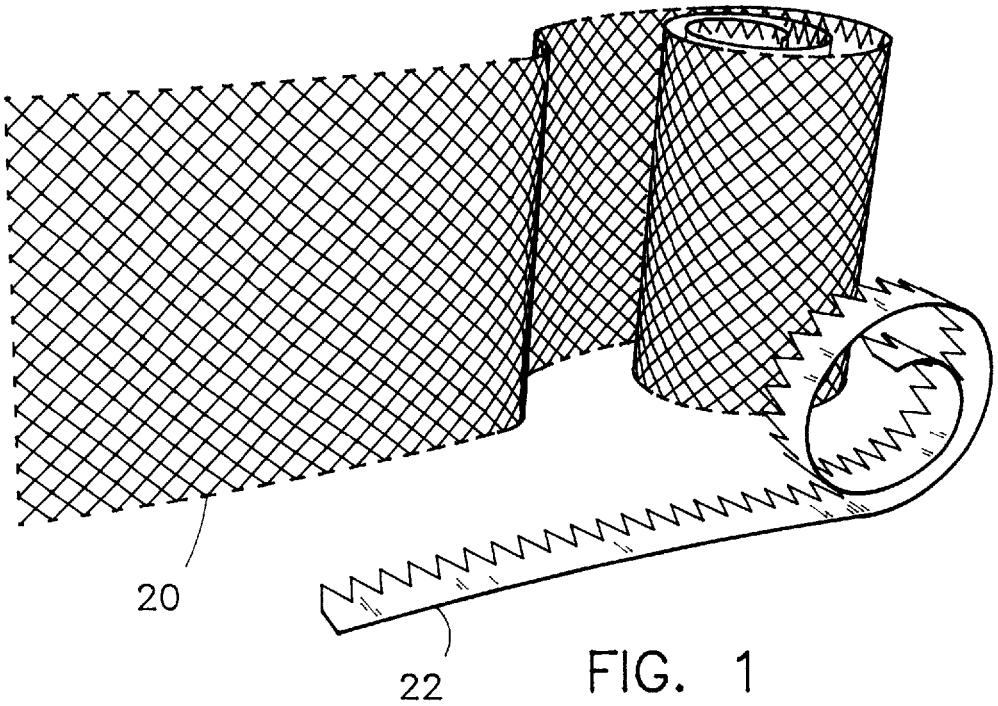
FIG. 1 is a side and top perspective view of a roll of netting material/and a first type of pronged strip of the preferred embodiment.

The fabric fastening kit of the preferred embodiment is illustrated broadly in FIG. 1. The fabric fastening kit is comprised firstly of a strip of large mesh network 20, having a nominal width, and which is preferably marketed in a spool form. The strip of netting material 20 is intended to be sewn to a piece of fabric to be fastened, in a manner that it overlaps a margin of that piece. The preferred strip of netting material 20 has a nominal content of plastic fibres and it is trimmed to size by a hot tool for working plastic sheeting material for example, such that the threads along the edges are slightly melted together for preventing fretting of these edges after an extended use of the fabric fastening kit.

As it was mentioned above, the strip of netting material 20 is trimmed to a nominal width as required by the intended application. For example, a width of about between six to eight inches is recommended for supporting a drapery. Similarly a nominal width of about between four to six inches is recommended for retaining a slip cover to a chair frame, and a nominal width of about between two to four inches is appropriate to retain a protective cover on a piece of outdoor equipment.

The fabric fastening kit is also comprised of a pronged element 22 which is also preferably marketed is coil form. The pronged element 22 is preferably a thin strip of plastic material, having a thickness of between about 0.030 inch to about 0.040 inch. The plastic material is preferably a polyethylene material.

The plastic pronged element 22 is thereby easily manufactured with tooling common in the art of plastic works. The plastic pronged element 22 is also easily severed at an appropriate length, and readily attachable to a wood structure by staples. The polyethylene pronged element is flexible, whereby it can be fitted to curved base frames. Furthermore, it has been found that the polyethylene pronged element 22 springs backwardly for releasing the netting material 20 when a sudden force is applied on the fabric. This last feature has been found advantageous for preventing the damaging of a supported fabric when an inadvertent pull is suddenly applied on it.

Figure 2:
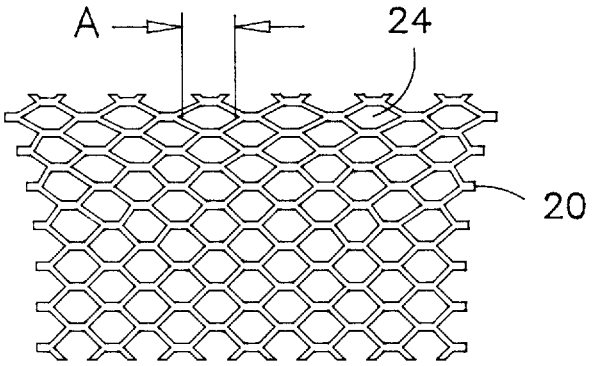
FIG. 2 is a plan view of a section of the netting material of the preferred embodiment.
Figure 3:
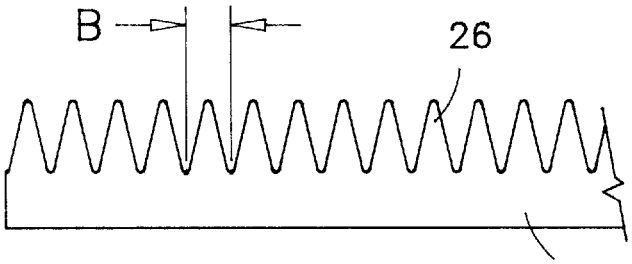
FIG. 3 is a plan view of a first type of pronged strip of the preferred embodiment.
Figure 4:
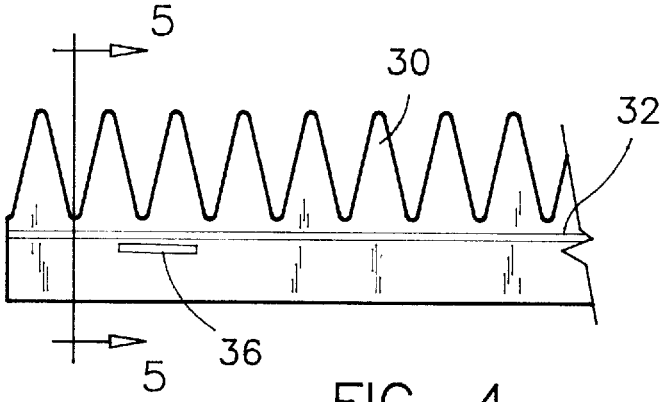
FIG. 4 is a plan view of a second type of pronged strip of the preferred embodiment.

Referring now to FIGS. 2 and 3, one essential feature of the fabric fastening kit of the preferred embodiment is that the netting material 20 is stretchable to a certain extent, such that the width of one mesh 24, as shown by label 'A' is similar to the maximum base width of one triangularlike prong 26 of the pronged strip 22, as shown by label 'B'. Hence, the perimeter of one mesh 24 is about twice as much as the width of one prong 26 at the base of the prong. The pronged strip 22 is thereby attachable at any location across the area of the netting material 20 without breaking any tread in the material.

When the pronged element of the first type 22 is mounted on a rigid structure which has a large surface area, the pronged element is preferably attached to the rigid structure with a spacer strip between the backside thereof and the surface of the rigid structure. The prongs 26 are thereby spaced from the surface of the structure to facilitate the attaching of the netting material 20 to the prongs 26. In this regard it has been found that a strip of felt or thick fabric performs quite satisfactorily Several configurations of pronged strips are usable in the fabric fastening kit of the preferred embodiment. Examples of pronged strips of different types are suggested herein and are illustrated in FIGS. 4 to 10. Although only five pronged strips are illustrated and described herein, it will be appreciated by the persons knowledgeable in the art, that numerous other types of pronged strip may also be used in combination with the netting material of the preferred embodiment, to obtain the advantages of the present invention.

Figure 5:
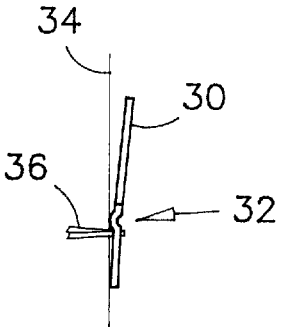
FIG. 5 is a cross-section view of the pronged strip of the second type, through line 5—5 in FIG. 4.
Figure 6:
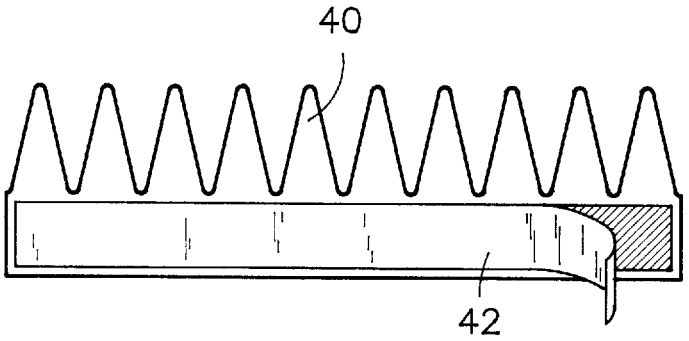
FIG. 6 is a plan view of a third type of pronged strip of the preferred embodiment.
Figure 7:
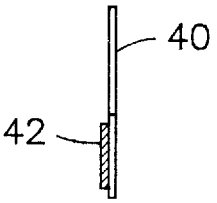
FIG. 7 is an end view of the pronged strip of the third type.
Figure 8:
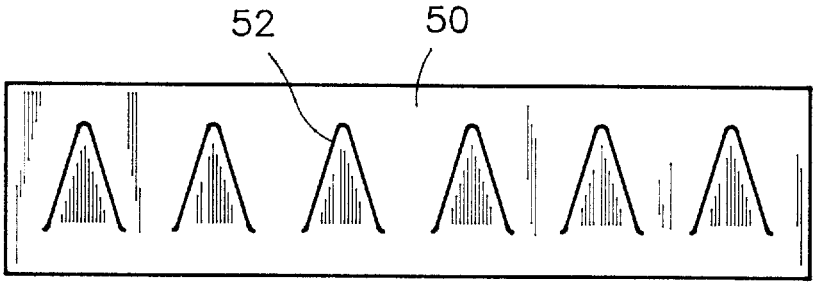
FIG. 8 is a plan view of a fourth type of pronged strip of the preferred embodiment.
Figure 9:
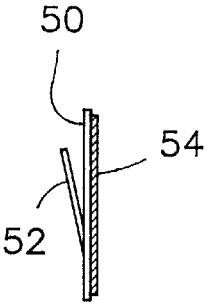
FIG. 9 is an end view of the pronged strip of the fourth type.

A pronged strip of the second type 30 has a crease 32 there-along near the base of each prong and bulging through a rear surface of the strip. Therefore, when the pronged strip 30 is attached to a wall surface 34 by means of staples 36 or by other fasteners installed below the crease, the protruding part of the crease causes the prongs to lean forwardly, such that the tip of the prongs are spaced from the wall surface 34 as illustrated in FIG. 5, to facilitate the attaching of the netting material to the prongs.

A pronged strip of a third type 40 has a finite length and is preferably packaged and marketed in bundle of several strips 40, the quantity of which is sufficient for matching the length of a spool of netting material 20. The pronged strip of the third type 40, has an adhesive tape 42 attached to the backside thereof, such that it can be readily mounted on a painted smooth surface for example, without requiring any mechanical fasteners. One type of preferred adhesive tape 42 is a double-sided tape referred to in the trade as "carpet tape". Although many types of adhesive tapes are acceptable for this application, it is recommended to use an adhesive tape which has a nominal thickness being at least as much as the thickness of the netting material, for the same reason as explained earlier.

The fourth type of pronged strip 50 usable with the netting material 20 of the preferred embodiment is manufactured in finite lengths or in a coiled form. The pronged strip of the fourth type 50 has straight edges and spaced apart prongs 52 protruding through the central region thereof. The pronged strip 50 preferably has an adhesive tape 54 mounted on the back surface thereof.

Each prong 52 is oriented transversally relative to the strip 50, and is preferably formed by partly cutting the strip with a V-shaped punch and die installation. The cutting of each prong 50 is preferably effected by a punch and die set having a relatively large clearance therebetween. This dull cut leaves burrs along the edges of the cut, for refraining the prong 52 from springing back flush within the base material.

Figure 10:
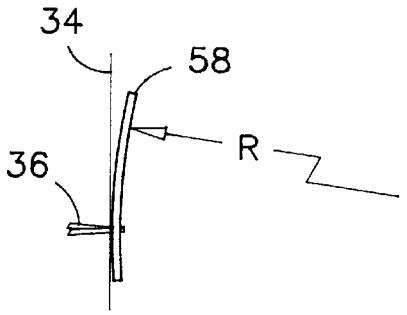
FIG. 10 is an end view of the pronged strip of the fifth type.

An end view of the pronged element 58 of the fifth type is illustrated in FIG. 10. The pronged element 58 of the fifth type has a concave surface. The curvature of this concave surface has a nominal radius "R", and an arc thereof is oriented transversely relative to the element 58. Hence, when the pronged element 58 is attached to a flat mounting surface 34, the prongs are spaced from that mounting surface 34. The concave surface of the pronged element 58 is formable with forming tools common in the art of metal and plastic works. On the other hand, it has been observed that a concave surface is often inherent in thin strips of polyethylene or other type of flexible plastic material, and additional forming of those strips is generally not required.

Figure 11:
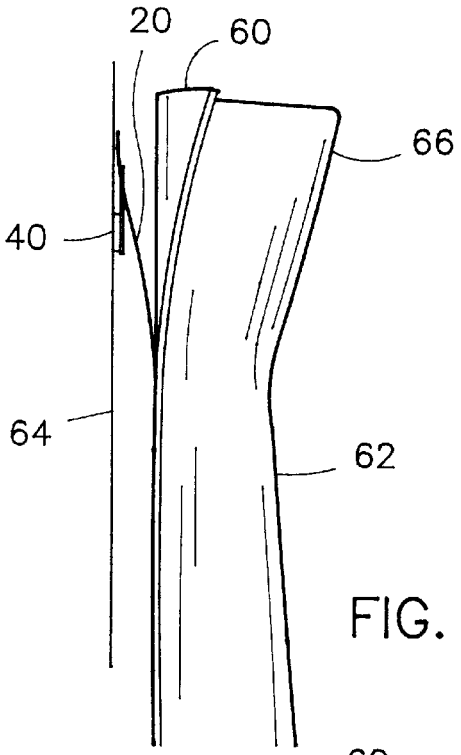
FIG. 11 is a side view of a drapery retained to a wall surface by the netting material and a pronged strip of the preferred embodiment.
Figure 12:
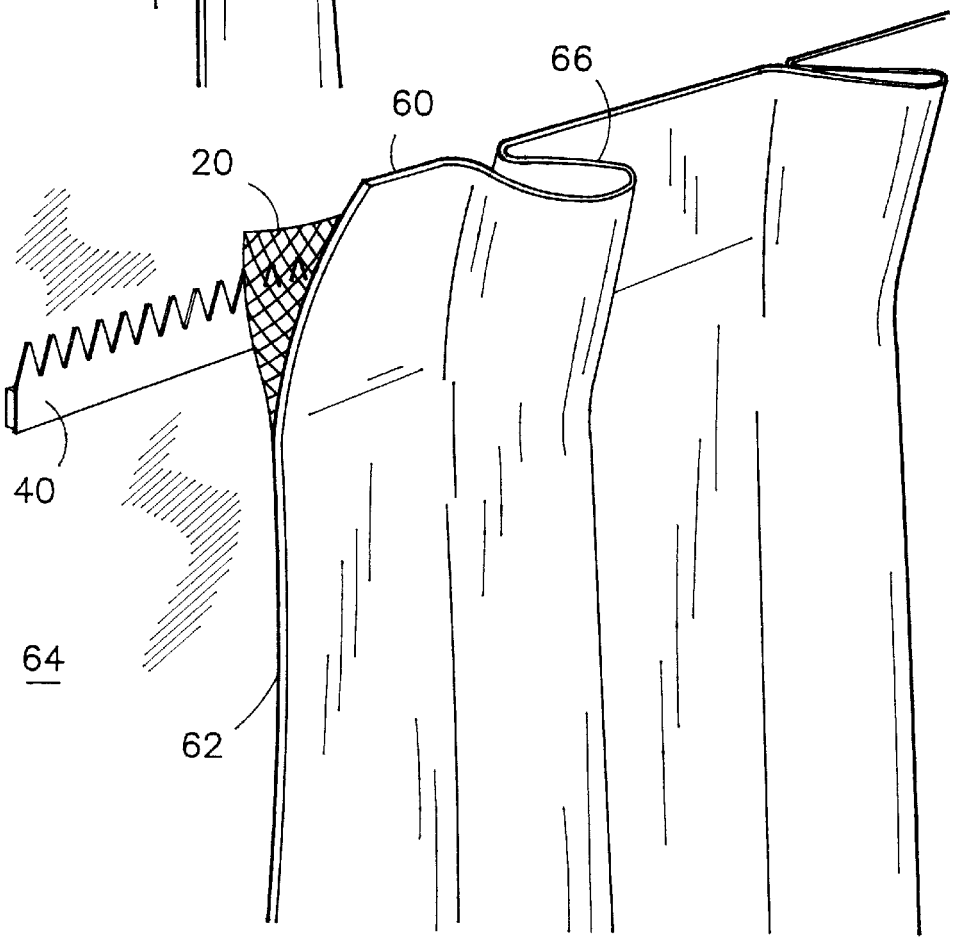
FIG. 12 is a side and top perspective view of the drapery in FIG. 11.

Referring now to FIGS. 11 and 12, there is illustrated therein, a first typical application for the fabric fastening kit of the preferred embodiment. A strip a netting material 20 according to the preferred embodiment is sewn along the upper margin 60 of a drapery 62, in a position such that it overlaps the margin 60 of the drapery. A pronged strip 40 is mounted on a wall surface 64 at a location where the upper edge of the drapery is intended to hang. The drapery 62 is thereby readily attachable to the pronged strip 40, and a height thereof is readily adjustable over the full width of the netting material 20.

Moreover, the fabric fastening kit of the preferred embodiment is also useful for forming pleats 66 in a drapery 62, by pulling the material on itself at intervals before hanging the netting strip 20 on the pronged element 40.

It will be appreciated that the fabric fastening kit of the preferred embodiment is convenient for periodically suspending a drapery or a wall covering fabric to a wall, for a special occasion, during holiday seasons for examples, without damaging the upper margin thereof. The fabric fastening kit of the preferred embodiment is also useful for suspending banners, wall tapestry, trade show displays and artistic wall hangings of all sorts.

Figure 13:
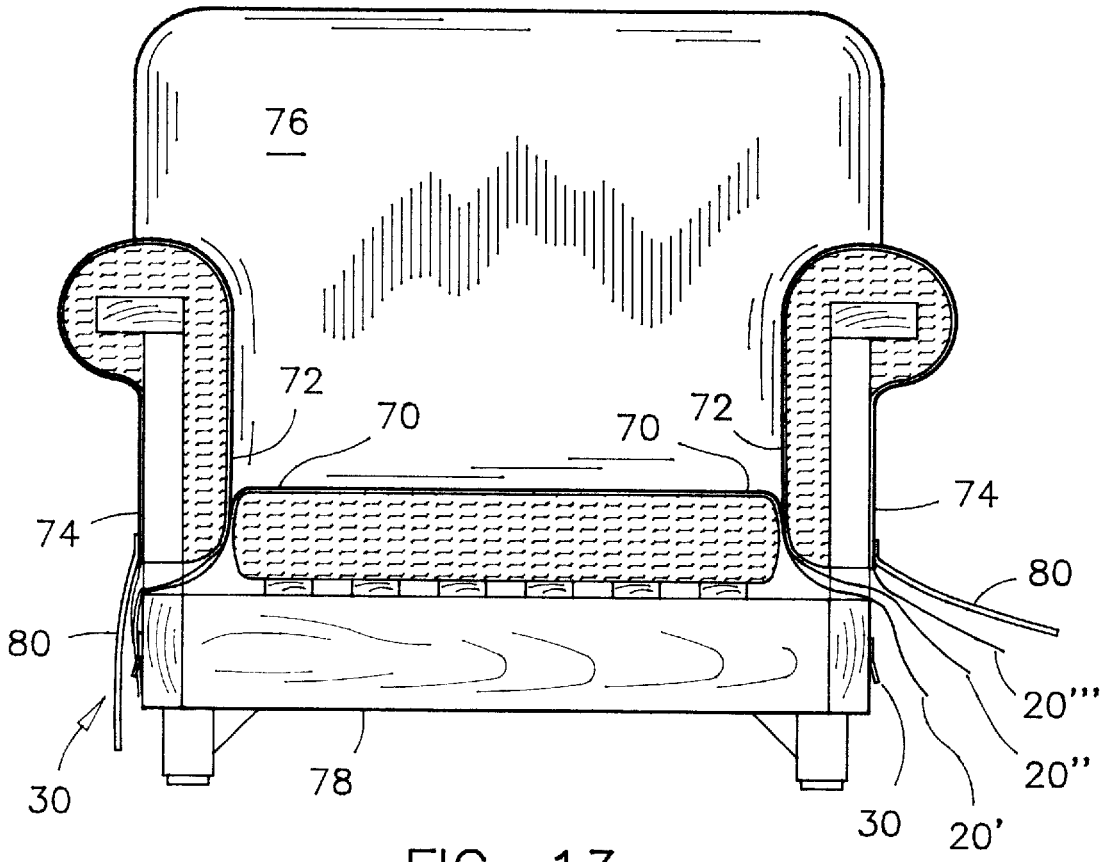
FIG. 13 is a cross section view of a chair having a slip cover thereon which is retainable to the chair by the netting material and pronged strip of the preferred embodiment.
Figure 14:
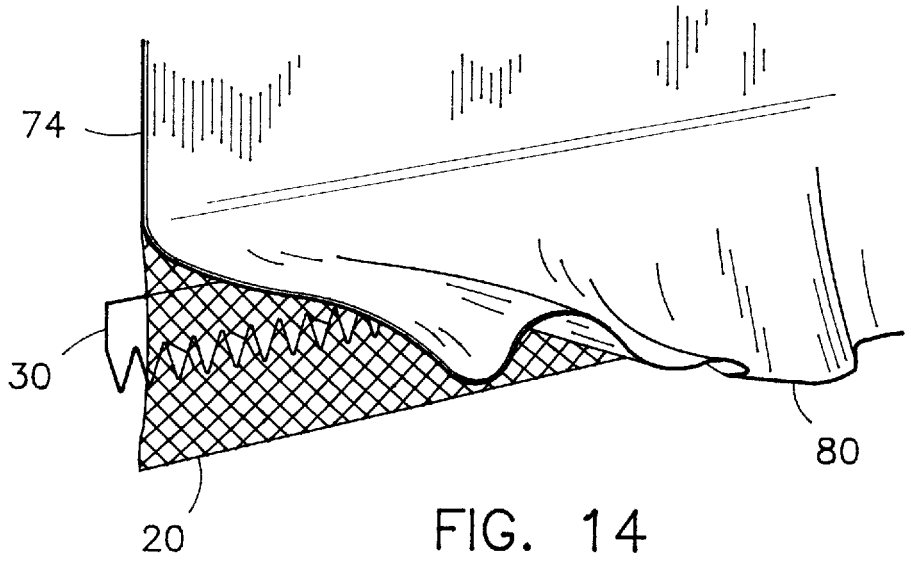
FIG. 14 is a front and side perspective view of the lower side section of the chair in FIG. 13.

A second typical application for the fabric fastening kit of the preferred embodiment is illustrated in FIGS. 13 and 14. The netting strip 20 of the fabric fastening kit of the preferred embodiment is attachable to all the fringes 70,72, 74 of a slip cover 76 for a sofa chair, and the pronged strip 30 is attachable to the frame 78 of the chair. One of the advantages of using the fabric fastening kit to retain a slip cover 76 on a chair, is that several layers of netting material are attachable to the same pronged element 30. For example, the netting 20' on a fringe 70 from a deck cover, the netting 20" from the inside fringe 72 of an arm cover and the netting 20'" from the outside fringe 74 of the arm cover are all attachable to the pronged strip 30. In this typical installation, a skirting strip 80 is preferably provided to conceal the netting strips and the pronged elements and to advantageously provide this chair with a neat appearance.

A further advantage of this particular embodiment of the present invention, is that the netting on each of fringes 20',20",20'" are stretchable over their full width, for adjusting a slip cover 76 which has shrunken during a recent laundry or which has slackened from extended use.

Figure 15:
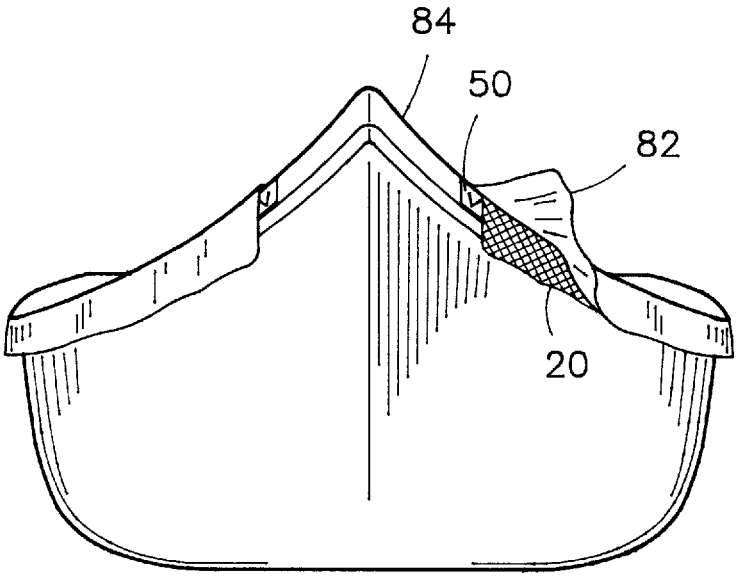
FIG. 15 illustrates a canoe having a protective cover installed thereon using the netting material and the pronged strip of the preferred embodiment.
Figure 16:
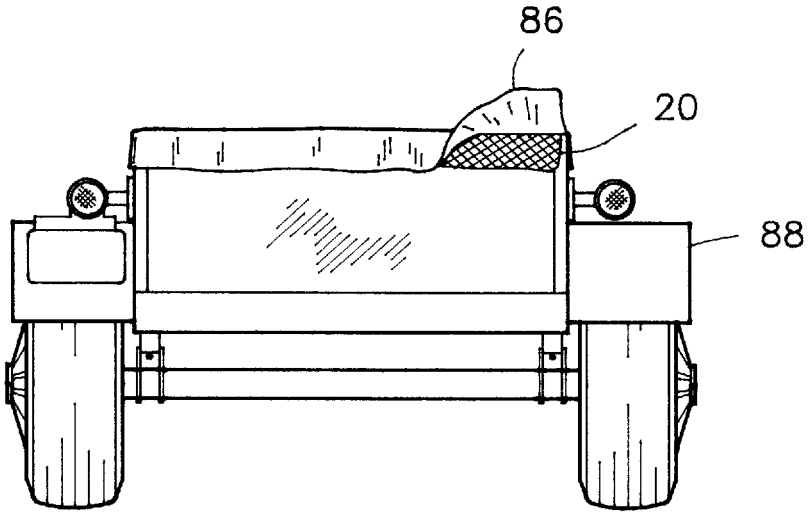
FIG. 16 illustrates another protective cover having a strip of netting material of the preferred embodiment, and being retained on an utility trailer.

Other uses are possible for the fabric fastening kit of the preferred embodiment. These other applications are numerous and include for examples a first protective cover 82 for covering a canoe 84 as illustrated in FIG. 15, and a second protective cover 86 for covering an utility trailer 88 as illustrated in FIG. 16. The netting strips 20 of those protective covers 82,86 are installed according to the aforesaid manner, that is to overlap the underside margins of the covering material. The pronged strips 50 are attached or glued on the rim member of the structure to be covered. The protective covers 82,86 are repeatedly removed and reinstalled without damaging the outside margin thereof.

While the above description provides a full and complete disclosure of the preferred embodiment of this invention, various modifications, alternate constructions and equivalents may be employed without departing from the true spirit and scope of the invention. Such changes might involve alternate components, structural arrangements, construction features or the like. Therefore, the above description and the illustrations should not be construed as limiting the scope of the invention which is defined by the appended claims.

I claim:

1. A fabric fastening kit for fastening a piece of fabric to a structure, comprising:

an elongated pronged element for mounting on said structure, having a nominal width, a longitudinal measure, an uniform thickness, a backside, a foreside and a plurality of juxtaposed prongs defined therein; each of said prongs having a narrow tip, a wide base and a length between said tip and said base being substantially at least equivalent to a width of said base, and a mounting means for mounting on said fabric, said mounting means including a strip of netting material, having a nominal width and a plurality of open meshes, each of said meshes having a perimeter being at least twice as long as said width of said base of said prong, wherein said netting material is repeatedly tangentially attachable to and removable from said prongs without mangling said netting material.

2. A fabric fastening kit as claimed in claim 1 wherein said strip of netting material is a spool of netting material having said nominal width and said longitudinal measure of said pronged element is contingent a coiled strip having a continuity of said juxtaposed prongs.

3. A fabric fastening kit as claimed in claim 1 wherein said strip of netting material is a spool of netting material having said nominal width and said longitudinal measure of said pronged element has a finite length and said kit comprises a bundle containing a plurality of said pronged elements each having said finite length.

4. A fabric fastening kit for fastening a piece of fabric to a structure, comprising;

an elongated pronged element for mounting on said structure, having a nominal width, a longitudinal measure, an uniform thickness, a backside, a foreside and a plurality of juxtaposed prongs defined therein; each of said prongs having a narrow tip, a wide base and a length between said tip and said base being substantially at least equivalent to a width of said base, and a strip of netting material for mounting on said fabric, having a nominal width and a plurality of open meshes, each of said meshes having a perimeter being at least twice as long as said width of said base of said prong, said netting material having a nominal content of a plastic fibers and said plastic fibers along an edge of said strip of netting material being partly melted together for preventing a fretting of said edge during use thereof.

5. A fabric fastening kit as claimed in claim 4 wherein said pronged element has a longitudinal axis and said nominal width of said pronged element defines a concave surface having an arc of curvature oriented transversely relative to said longitudinal axis and extending throughout said nominal width of said pronged element.

6. A fabric fastening kit as claimed in claim 4 wherein said pronged element comprises a spacer means mounted on said backside thereof for spacing said prongs from said structure when said pronged element is held against said structure.

7. A fabric fastening kit as claimed in claim 6 wherein said pronged element has a crease formed longitudinally there-along and adjacent said bases of said prongs, and said spacer means is a portion of said crease bulging on said backside thereof.

8. A fabric fastening kit as claimed in claim 6 wherein said spacer means is an adhesive tape, and said adhesive tape has a nominal thickness which is at least as much as a thickness of said netting material.

9. A fabric fastening kit as claimed in claim 4 wherein said nominal width is comprised of a number of said open meshes and said prongs are oriented transversely relative to said elongated pronged element, whereby when said strip of netting material and said pronged element are parallel to one-another, said strip of netting material is laterally adjustably attachable to said prongs relative to said pronged element.

10. A fabric fastening kit as claimed in claim 4 wherein said elongated pronged element is a strip having one straight edge and one jagged edge, and said jagged edge is defined by said plurality of juxtaposed prongs.

11. A fabric fastening kit as claimed in claim 10, wherein said strip is made of polyethylene, and said uniform thickness is between about 0.030 inch and about 0.040 inch, whereby said prongs are relatively flexible and said pronged element is perforable by staples.

12. A fabric fastening kit as claimed in claim 4 wherein said longitudinal measure of said prong element is contingent a coiled strip having a continuity of said juxtaposed prongs.

13. A fabric fastening kit as claimed in claim 4 wherein said elongated pronged element comprises two parallel straight edges, and each of said prongs is defined by a pair of joining angularly spaced linear cuts through said uniform thickness and included within said straight edges.

14. A fabric fastening kit as claimed in claim 13 wherein said cuts have burrs there-along, for preventing said prongs from returning into an alignment of said nominal width of said pronged element when said prongs are folded to form an angle with said alignment of width of said pronged element.

15. A fabric fastening kit as claimed in claim 4 wherein said longitudinal measure of said pronged element has a finite length and said kit comprises a bundle containing a plurality of said pronged elements each having said finite length.

16. A fabric fastening kit as claimed in claim 4 wherein said strip of netting material is a spool of netting material having said nominal width.

17. A pronged element for mounting on a rigid structure and for retaining a piece of netting material thereto, said pronged element having:

a nominal width, a longitudinal measure, an uniform thickness, a backside, a foreside and a plurality of juxtaposed prongs defined therein;

each of said prongs having a narrow tip, a wide base and a length between said tip and said base being substantially at least equivalent to a width of said base;

a crease formed longitudinally there-along and adjacent said bases of said prongs, with a portion of said crease bulging on said backside thereof for spacing said tips of said prongs from said structure when said pronged element is held against said structure.

18. A pronged element as claimed in claim 17 wherein said nominal width and longitudinal measure define a strip having one straight edge and one jagged edge, and said jagged edge is defined by said plurality of juxtaposed prongs.

19. A pronged element as claimed in claim 17 wherein a material of fabrication thereof is polyethylene and said uniform thickness is between about 0.030 inch and about 0.040 inch.

20. A pronged element as claimed in claim 17 wherein said longitudinal measure is contingent a coiled strip having a continuity of said juxtaposed prongs.

* * * * *